US008112924B2

(12) United States Patent
Longobardo

(10) Patent No.: US 8,112,924 B2
(45) Date of Patent: Feb. 14, 2012

(54) EXPANDABLE SIGN SUPPORT ASSEMBLY

(76) Inventor: Vincent A. Longobardo, Charlotte, NC (US)

( * ) Notice: Subject to any disclaimer, the term of this patent is extended or adjusted under 35 U.S.C. 154(b) by 0 days.

(21) Appl. No.: 12/467,461

(22) Filed: May 18, 2009

(65) Prior Publication Data

US 2010/0287803 A1 Nov. 18, 2010

(51) Int. Cl.
*G09F 15/00* (2006.01)

(52) U.S. Cl. ..... 40/606.13; 248/298.1; 248/346.07

(58) Field of Classification Search ..... 40/606.13, 40/607.03, 741, 739, 209, 645; 248/298.1, 248/346.06, 346.07
See application file for complete search history.

(56) References Cited

U.S. PATENT DOCUMENTS 2,101,500 A * 12/1937 Jagus ..... 40/606.13
2,164,299 A * 6/1939 Mandell et al. ..... 40/741
2,881,502 A * 4/1959 Dopera ..... 432/259
3,688,341 A 9/1972 Peckham
4,090,464 A * 5/1978 Bishopp et al. ..... 116/63 R
6,594,932 B2 7/2003 Hurst, III et al.
6,637,608 B1 * 10/2003 Schneider ..... 211/90.02
6,913,835 B2 7/2005 Aoki et al.
7,107,713 B2 9/2006 Simson
2003/0126778 A1 * 7/2003 Arko et al. ..... 40/606.01

* cited by examiner

*Primary Examiner* — Joanne Silbermann
*Assistant Examiner* — Kristina N Staley
(74) *Attorney, Agent, or Firm* — Shumaker, Loop & Kendrick, LLP

(57) ABSTRACT

An expandable support assembly for hanging a sign on a host structure subject to dimensional changes over time includes a pair of elongate arms pivotally attached together at a crossing point, a connector pivotally attaching the elongate arms together and permitting the arms to rotate relative to each other, four anchors, and a panel attached to the connector for supporting the sign. Each anchor engages a respective longitudinal portion of one of the arms such that the connector is positioned between two anchors with respect to each arm. The anchors are movable along the arms for securing the expandable support assembly to the host structure. The arms are adapted to permit movement of the anchors along the arms and the connector is adapted to permit relative rotation of the arms in response to dimensional changes over time of the host structure.

18 Claims, 4 Drawing Sheets

EXPANDABLE SIGN SUPPORT ASSEMBLY

FIELD OF THE INVENTION

This invention relates generally to a sign support, and more particularly to an expandable sign support assembly that adapts to the changing dimensions of a host structure such as a living tree.

BACKGROUND OF THE INVENTION

Owners and managers of controlled land and facilities often attach signs to trees and other structures that are subjected to varying weather conditions. However, when a sign is attached directly to a growing tree or a structure that responds to varying conditions by undergoing dimensional changes, the sign may be torn apart or fall from the tree or other structure over several seasons. Unwanted inconveniences may occur and dangers may arise as uninformed visitors are exposed to unexpected conditions or hazards that a lost sign was intended to address. Furthermore, the loss of the sign may result in unwanted trespassing and may even permit the assumption of unwanted liabilities. Land owners and managers typically therefore must return to posted areas to replace lost or damaged signs.

As a tree grows, it may exhibit growth in both in height and diameter. Any signage nailed at four corners may be damaged or lost as the tree carries the nails further and further from each other both in vertical and horizontal directions. Plywood, metal panels, and other constructions materials may similarly destroy or cause the loss of a sign due to thermal expansions and contractions of both the host material and the signage material as seasonal or even daily temperatures cycle from hot to cold and back many times.

Therefore, an improved sign support assembly that adapts to the changing dimensions of a host structure such as a living tree is needed.

BRIEF SUMMARY OF THE INVENTION

Accordingly, there is a need for a sign support assembly that expands in response to dimensional changes of a host structure. This need and other benefits and advantages are met by the present invention, of which several embodiments are within the scope of these descriptions. According at least to a first embodiment, an expandable support assembly for hanging a sign on a host structure subject to dimensional changes over time includes a pair of elongate arms pivotally attached together at a crossing point, a connector pivotally attaching the elongate arms together at the crossing point and permitting the arms to rotate relative to each other, four anchors, and a panel attached to the connector for supporting the sign. Each anchor engages a respective longitudinal portion of one of the arms such that the connector is positioned between two anchors with respect to each arm. The anchors are movable along the arms for securing the expandable support assembly to the host structure. The arms are adapted to permit movement of the anchors along the arms and the connector is adapted to permit relative rotation of the arms in response to dimensional changes over time of the host structure.

In at least one example according to the first embodiment, each arm has a pair of slots positioned on opposing sides of the connector, and the anchors are movable within the slots in a dovetail engagement. Channels are formed along opposing sides of the anchors and inner edges of the slots are formed as rails that are received by the channels such that the anchors are trapped within the slots. In another example, the rails have toothed edges and the anchors have flexible clips that engage the rails in an indexing fashion such that the anchors are movable along the slots among spaced predetermined positions. Furthermore, in at least one example, each anchor has a hole formed therethrough for passing a fastener through the anchor and into the host structure to secure the expandable support assembly to the host structure. A clear protective film may be attached to the panel along an edge of the panel and an adhesive layer may be provided on the film facing the panel for fixing the sign between the panel and the clear protective film.

In at least one other embodiment, an expandable support assembly for hanging an object for display on a host structure subject to dimensional changes over time includes a pair of elongate arms pivotally attached together at a crossing point, and a connector pivotally attaching the elongate arms together at the crossing point and permitting the arms to rotate relative to each other. Each arm has a pair of slots positioned on opposing sides of the connector for passing fasteners through the arm and into the host structure to secure the expandable support assembly to the host structure while permitting movement of the fasteners along the slots and relative rotation of the arms in response to dimensional changes over time of the host structure.

BRIEF DESCRIPTION OF THE DRAWINGS

The subject matter that is regarded as the invention may be best understood by reference to the following description taken in conjunction with the accompanying drawing figures in which.

DETAILED DESCRIPTIONS

Figure 1:
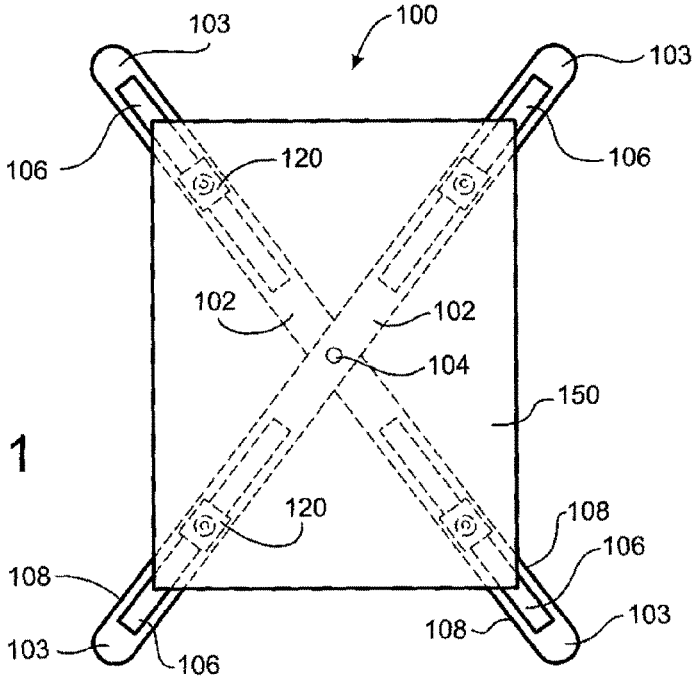
FIG. 1 is a front plan view of a sign support assembly according to at least one embodiment of the present invention.
Figure 2:
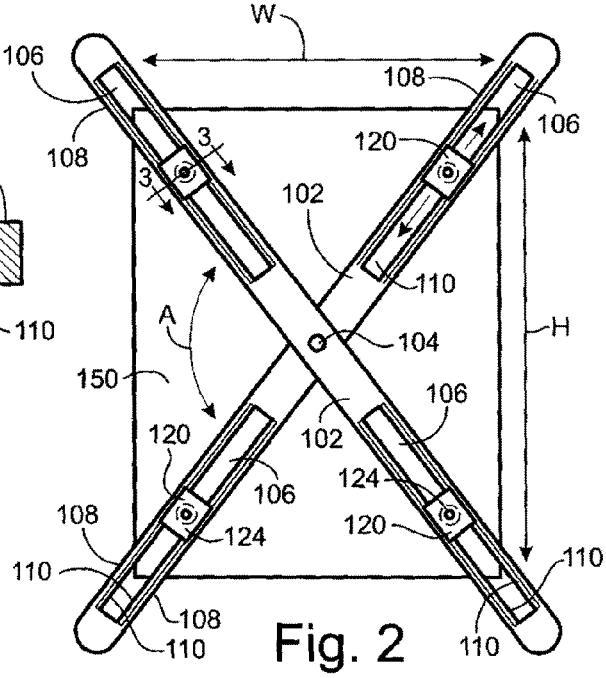
FIG. 2 is a rear plan view of the sign support assembly of FIG. 1.

Referring to the drawings, wherein identical reference numerals denote the same elements throughout the various views, FIGS. 1 and 2 respectively provide front and back views of a sign support assembly 100, according to one embodiment of the present invention. The sign support assembly 100 includes a crossed pair of arms 102 pivotally connected together approximately at their centers by a connector 104. Each arm 102 has a pair of slots 106 positioned opposite each other along opposing ends of the arm 102 with the connector 104 positioned between the slots 106. The inner edges of the slots 106 are formed as rails 108 such that two rails 108 are positioned along opposing sides of each slot 106.

Figure 3:
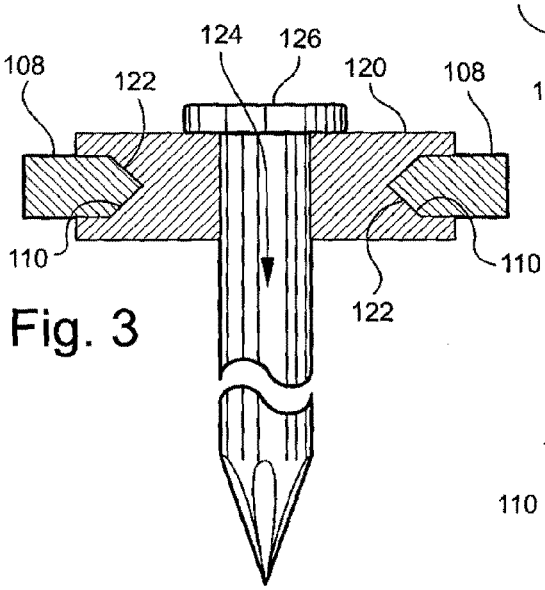
FIG. 3 is a cross-sectional view of the sign support assembly of FIG. 1 taken along the line 3-3 of FIG. 2.

An anchor 120 engages the rails 108 within each slot 106 and is able to travel within the slot 106 by sliding along the rails 108. In the illustrated example, the rails 108 have beveled edges 110 received by channels 122 formed along opposing sides of the anchors 120 such that the anchors 120 are trapped within the slots 106. By this arrangement, the rails 108 and anchors 120 slidably engage each other in dovetail fashion as shown in FIG. 3. Thus, in the illustrated embodiment, the positions of the anchors 120 are continuously adjustable along the slots 106. In at least one other example, the rails have toothed or racked edges and the anchors have flexible or biased pins or clips that engage the rails in an indexing fashion such that the anchors 120 are movable along the slots 106 among spaced predetermined positions. In either example, the anchors 120 are able to move along the slots 106 when external forces are applied.

A hole 124 is formed through each anchor 120 for passing a fastener 126 such as a nail or screw through the anchor 120 as shown in FIG. 3. When a respective fastener 126 is passed through each hole 124 and fastened to a host structure such as a tree or post, the sign support assembly 100 serves as a four-point support for displaying a sign 200 as represented in FIG. 6.

The connector 104 represents a rivet, a threaded connector, a rod, a dowel, a headed cotter pin or other pivotal attaching implement or arrangement by which the arms 102 are pivotally connected together approximately at their centers. The connector 104 permits rotation of each arm 102 relative to the other. Therefore the height H and width W of the sign support assembly 100 shown in FIG. 2 vary together with the variable relative angle A between the two arms 102. The figures are not drawn to any particular scale and thus represent a variety of overall height and width configurations of the sign support assembly 100. The sign support assembly 100 can assume taller (H) and more narrow (W) configurations than shown in the figures as well as shorter (H) and wider (W) configurations, according to the variable relative angle A.

Figure 5:
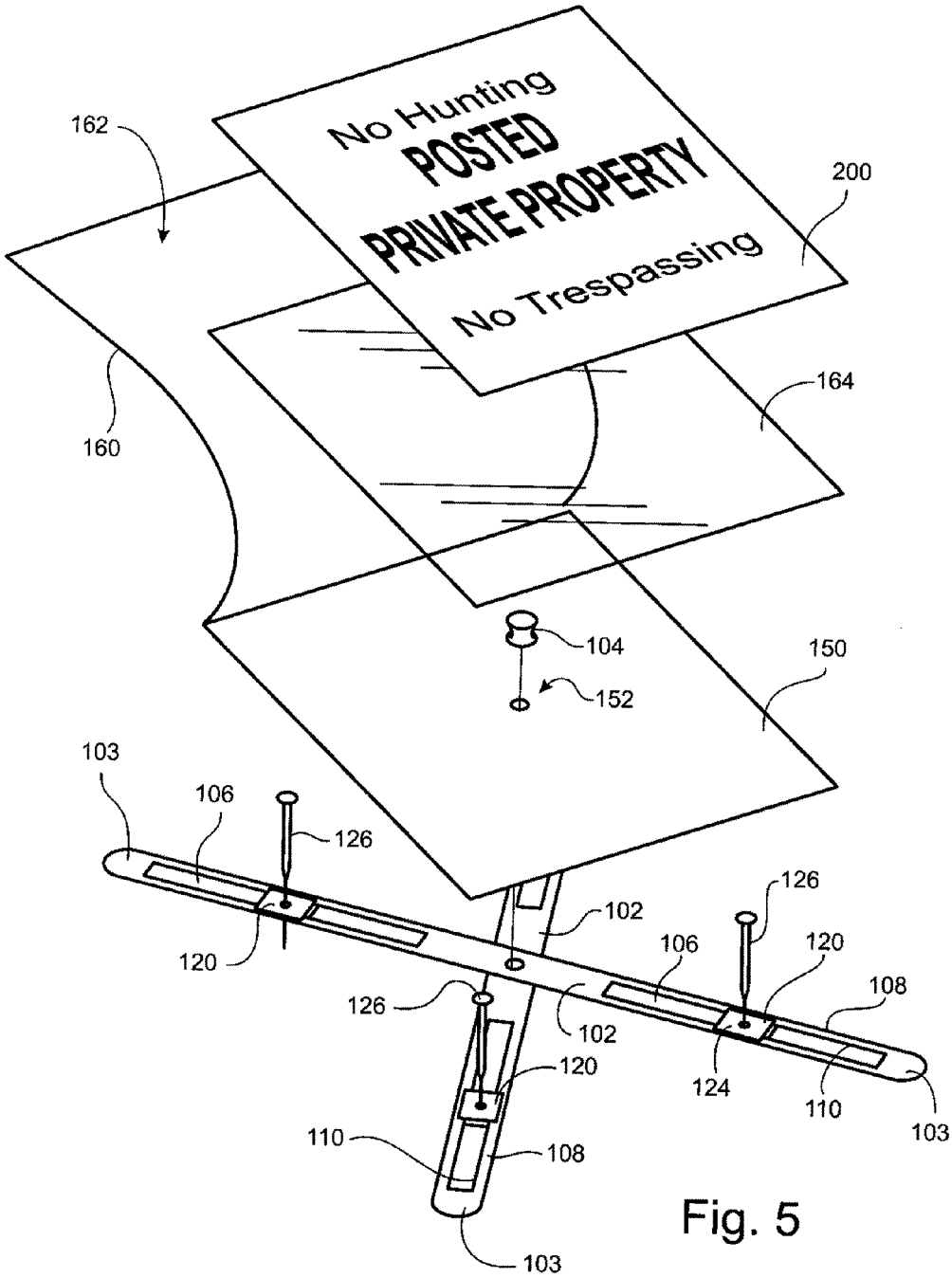
FIG. 5 is an exploded perspective view of the sign support assembly of FIG. 1 shown with the exemplary sign of FIG. 4.
Figure 6:
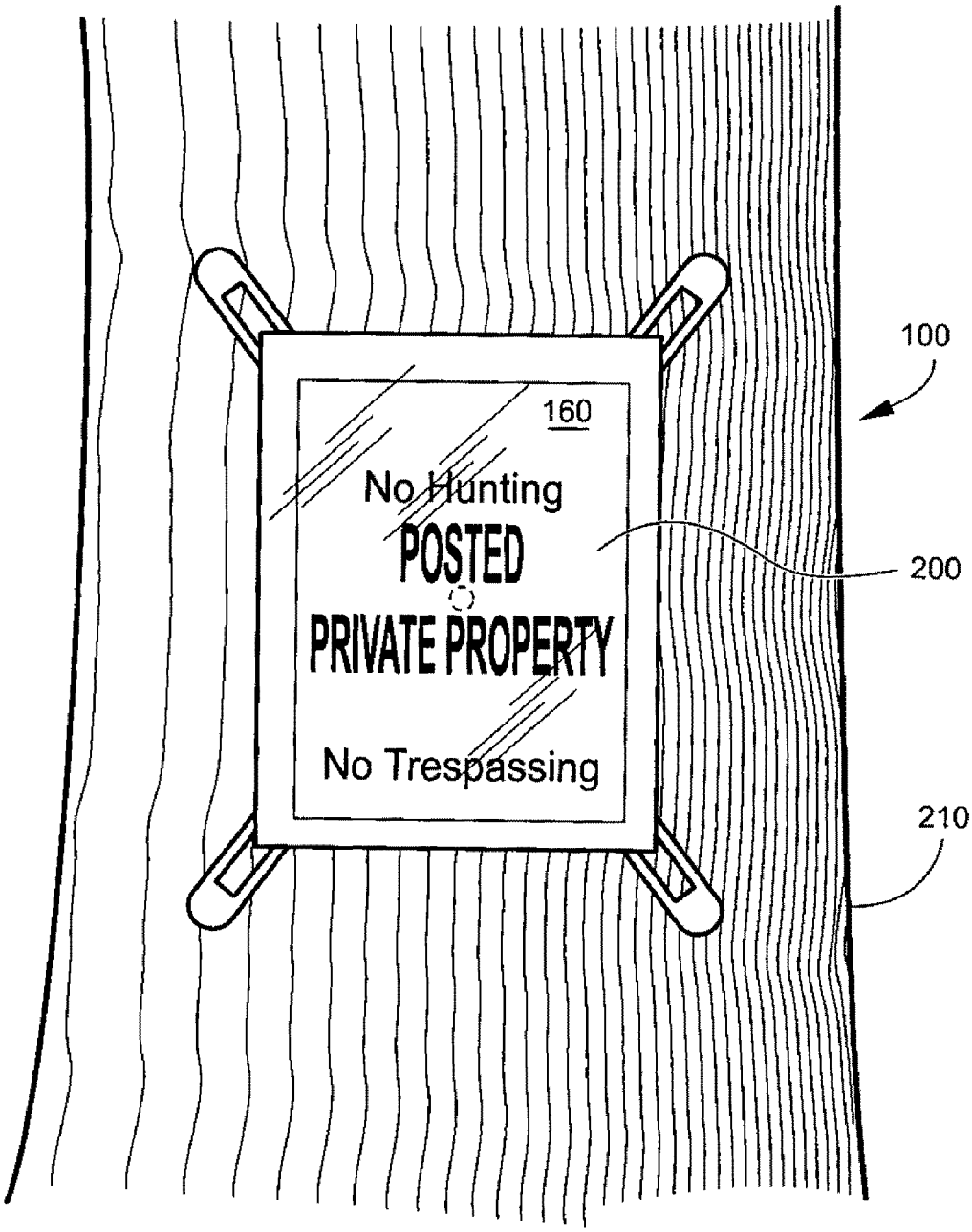
FIG. 6 is an environmental view of the sign support assembly of FIG. 1 and the exemplary sign of FIG. 4 shown together mounted upon a tree.

A panel 150, shown without the sign 200 in FIGS. 1-2, is attached to the connector 104 for supporting the sign 200 as shown in FIG. 6. The panel is rigid or semi rigid and supports the sign 200 against external forces such as the forces of wind and gravity. This is particularly advantageous when the sign 200 is made of paper or other flexible material. In the illustrated embodiment, the panel 150 is attached to the connector 104 at approximately the center 152 (FIG. 5) of the panel 150.

Figure 4:
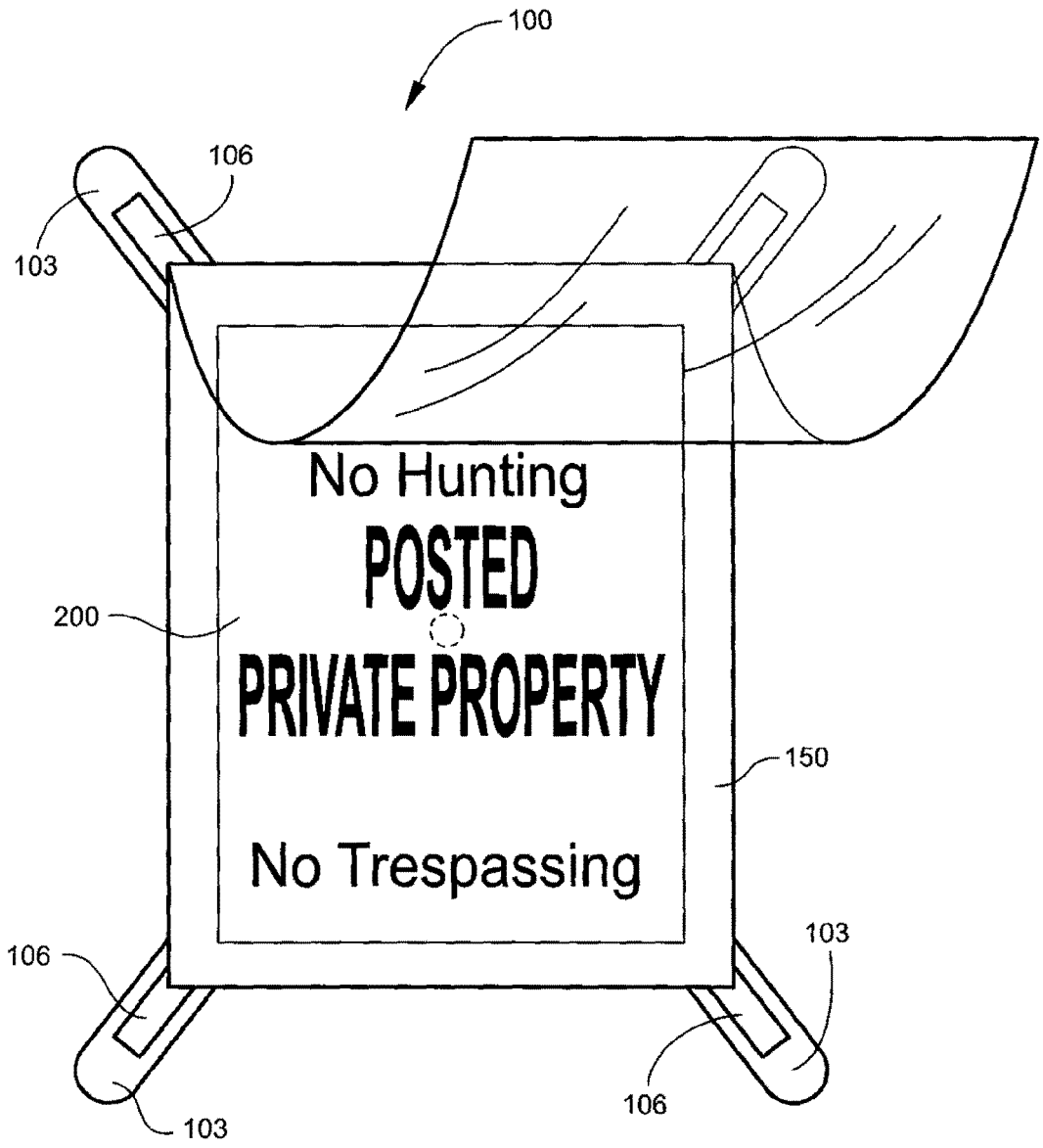
FIG. 4 is a perspective view of the sign support assembly of FIG. 1 shown with an exemplary sign.

As shown in FIGS. 4-5, a clear protective film 160 is attached to the panel 150 along an edge thereof. An adhesive layer 162 on the film 160 generally faces the panel 150 for fixing the sign 200 between the panel and the film 160. As shown in FIG. 5, a removable layer 164, which may be a sheet of waxed paper for example, is releasably adhered to the adhesive layer 162 on the film 160 to protect the adhesive layer 162 from collecting debris before use. The removable layer 164 is removed from the adhesive layer 162 to prepare the clear protective film 160 for use. Once the removable layer 164 is removed, the sign 200 is placed between the clear protective film 160 and the panel 150, and the clear protective film 160 is then pressed down upon the sign 200 and any margins of the panel 150 that are not covered by the sign 200. If margins are left on all sides of the sign, for example when the planar dimensions of the sign 200 are less than that of the panel 150, then the sign 200 is sealed between the clear protective film 160 and the panel 150 and is protected from air wind and moisture. This is particularly advantageous when the sign 200 is made of paper or other material vulnerable to degradation by contact with outdoor elements.

The sign support assembly 100 is shown fastened to the trunk of a tree 210 in FIG. 6. An exemplary sign 200 is supported by the sign support assembly and is protected by the clear protective film 160. Over time, the tree 210 exhibits dimensional changes by growing in both in height and diameter. As the tree 210 grows, the anchors 120 likely move outward along their slots 106 to accommodate the growth of the tree 210 while the fasteners 126 (FIGS. 3 and 5) travel with the growth of the tree. As needed, the angle A (FIG. 2) varies by relative rotation of the arms 102 around the connector 104 as the tree grows in height and diameter and the growth is not accommodated across time by a single fixed angle A.

A prudent user will install the sign support assembly 100 with fairly balanced width W and height H (FIG. 2) to accommodate the somewhat unpredictable growth ratios of the tree. A wise user will initially position the anchors 120 within the slots 106 inward from the longitudinal ends 103 of the arms to permit the anchors 120 to slide along the slots 106 away from the connector 104 as the tree grows.

The foregoing has described a sign support assembly. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. An expandable support assembly for hanging a sign on a host structure subject to dimensional changes over time, the support assembly comprising:

a) a pair of elongate arms pivotally attached together at a crossing point;

b) a connector pivotally attaching the elongate arms together at the crossing point and permitting the arms to rotate relative to each other;

c) four anchors, each one of which engages a respective longitudinal portion of one of the arms such that the connector is positioned between two anchors with respect to each arm, and each one of which is movable along the one arm for securing the expandable support assembly to the host structure;

d) a panel attached to the connector for supporting the sign; and e) wherein the arms are adapted to permit movement of the anchors along the arms and the connector is adapted to permit relative rotation of the arms in response to dimensional changes over time of the host structure, wherein each anchor is adapted to move longitudinally without affecting the position of the panel with respect to the connector.

2. An expandable support assembly according to claim 1, wherein each arm has a pair of slots formed through the arm and positioned on opposing sides of the connector, and wherein the anchors are movable within the slots.

3. An expandable support assembly according to claim 2, wherein the anchors are movable along the slots in a dovetail engagement.

4. An expandable support assembly according to claim 2, wherein channels are formed along opposing sides of the anchors and inner edges of the slots are formed as rails that are received by the channels such that the anchors are trapped within the slots.

5. An expandable support assembly according to claim 4, wherein the rails have toothed edges and the anchors have flexible clips that engage the rails in an indexing fashion such that the anchors are movable along the slots among spaced predetermined positions.

6. An expandable support assembly according to claim 1, wherein each anchor has a hole formed therethrough for passing a fastener through the anchor and into the host structure to secure the expandable support assembly to the host structure.

7. An expandable support assembly according to claim 1, wherein the panel is attached to the connector at approximately the center of the panel.

8. An expandable support assembly according to claim 1, further comprising a clear protective film attached to the panel along an edge of the panel and an adhesive layer on the film facing the panel for fixing the sign between the panel and the clear protective film.

9. An expandable support assembly according to claim 1, wherein the panel is constructed of a material selected from a list of materials consisting of metal, plastic, corrugated plastic, foam board, cardboard, and wood.

10. An expandable support assembly according to claim 1, wherein the panel is adapted to support the sign independently of the longitudinal position of any of the anchors.

11. An expandable support assembly according to claim 1, wherein the host structure is a live tree and the dimensional changes over time of the host structure comprises growth of the tree surface, the anchors being adapted to penetrate the tree such that growth of the tree over time permits relative rotation of the arms independent of support of the sign by the panel.

12. An expandable support assembly for hanging an object for display on a host structure subject to dimensional changes over time, the support assembly comprising:

a) a pair of elongate arms pivotally attached together at a crossing point;

b) a connector pivotally attaching the elongate arms together at the crossing point and permitting the arms to rotate relative to each other; and c) wherein each arm has a pair of slots formed through the arm and positioned on opposing sides of the connector for passing fasteners through the arm and into the host structure to secure the expandable support assembly to the host structure while permitting movement of the fasteners along the slots and relative rotation of the arms in response to dimensional changes over time of the host structure, wherein each fastener is adapted to move longitudinally without affecting the position of the panel with respect to the connector.

13. An expandable support assembly according to claim 12, further comprising a panel attached to the connector for supporting the object.

14. An expandable support assembly according to claim 13, wherein the panel is attached to the connector at approximately the center of the panel.

15. An expandable support assembly according to claim 13, further comprising a clear protective film attached to the panel along an edge of the panel and an adhesive layer on the film facing the panel for fixing the sign between the panel and the clear protective film.

16. An expandable support assembly according to claim 13, wherein the panel is constructed of a material selected from a list of materials consisting of metal, plastic, corrugated plastic, foam board, cardboard, and wood.

17. An expandable support assembly according to claim 12, wherein the host structure is a live tree and the dimensional changes over time of the host structure comprises growth of the tree surface, the fasteners being adapted to penetrate the tree such that growth of the tree over time permits relative rotation of the arms independent of support of the sign by the panel.

18. An expandable support assembly for hanging an object for display on a live tree subject to dimensional growth over time, the support assembly comprising:

a) a pair of elongate arms pivotally attached together at a crossing point;

b) a connector pivotally attaching the elongate arms together at the crossing point and permitting the arms to rotate relative to each other; and c) wherein each arm has a pair of slots formed through the arm and positioned on opposing sides of the connector for passing fasteners through the arm and into the tree to secure the expandable support assembly to the host structure while permitting movement of the fasteners along the slots and relative rotation of the arms, independent of support of the sign by the panel, in response to dimensional growth over time of the tree.

* * * * *